US005158398A

United States Patent [19]

Pinho

[11] Patent Number: 5,158,398

[45] Date of Patent: Oct. 27, 1992

[54] METHOD AND APPARATUS FOR AN EXCAVATION SUPPORT SYSTEM FOR TRENCHES

[75] Inventor: Francisco A. Pinho, Rahway, N.J.

[73] Assignee: F.P. & Sons, Inc., Colonia, N.J.

[21] Appl. No.: 834,004

[22] Filed: Feb. 11, 1992

[51] Int. Cl.[5] ..... E02D 17/08

[52] U.S. Cl. ..... 405/282; 405/272

[58] Field of Search ..... 405/262, 272, 282, 283, 405/285; 248/354.1

[56] References Cited

U.S. PATENT DOCUMENTS

| | | | |
|---|---|---|---|
| 3,910,053 | 10/1975 | Krings | 405/282 |
| 4,090,365 | 5/1978 | Nieber | 405/282 |
| 4,154,062 | 5/1979 | Koehl | 405/282 |
| 4,657,442 | 4/1987 | Krings | 405/282 |
| 4,685,837 | 8/1987 | Cicanese | 405/282 |

*Primary Examiner*—David H. Corbin

*Attorney, Agent, or Firm*—Lerner, David, Littenberg, Krumholz & Mentlik

[57] ABSTRACT

In order to support the walls of an excavation and prevent a cave-in of such walls, a preliminary trench is dug and its walls shored up by means of a trench box or trench shield placed therein. A series of soldier piles are driven into the soil below the trench box or trench shield and the excavation is made deeper. Reinforcement plates are moved between and along pairs of soldier piles to a depth below the trench box or trench shield to shore up the walls of the excavation below. By the use of multi-channel soldier piles a plurality of reinforcement plates set to differing depths can be used to shore the walls of the excavation as it is dug deeper in stages.

20 Claims, 8 Drawing Sheets

METHOD AND APPARATUS FOR AN EXCAVATION SUPPORT SYSTEM FOR TRENCHES

BACKGROUND OF THE INVENTION

1. Field of the Invention

The invention is directed to a method and apparatus for an excavation support system and, more particularly, to a method and apparatus for supporting the walls of an excavation to prevent a cave-in of the walls defining the excavation.

2. Description of the Prior Art

According to the prior art, a first portion of the trench was dug to a first depth and a trench box or support was assembled in or placed in such first portion. The trench was then dug to its full depth, making the trench approximately twice the depth of the first portion.

To support this additional trench depth, the U.S. Pat. No. 3,212,270 to Benintend issued Oct. 19, 1965 shows the use of plates 12 which slide downwardly along guides made up of flanges such as 20, 22 and 23 affixed to and within the walls of safety cage 11. Because only a single plate 12 can be accommodated by each set of flanges, the trench depth is limited to approximately twice the height of safety cage 11.

In U.S. Pat. No. 4,059,964 issued Nov. 29, 1977 to Pavese, there is shown a sheeting installation frame 71 which installed in the pit to a first depth. Sections 72 are then installed into support frame 71 and hammered downwardly through the undug soil beneath the support. Finally, the remainder of the pit is dug between the extended sections 72 (see FIGS. 9, 10 and 11). The marginal edges of sections 72 overlap so that a complete pit wall is created. Since frame 71 only provides for a single set of sections 72, the depth of the final pit is approximately equal to twice the height of support frame 71.

In Japanese Printed Publication 56-77422, after frame 2 is positioned in the trench mouth and shored up as with supports 3, panels 7 are made to engage channels created by guides 6 and slide downwardly behind the frame 2. Once panels 7 are in place, the remainder of the trench can be dug. Since the guides 6 can only handle one set of panels 7, the trench depth is limited to about twice the height of frame 2 (see FIGS. 6 and 7).

The prior art does not show how a trench can be supported, which trench has a depth a number of times the height of the trench box or shield. The present invention is directed to meet these needs.

SUMMARY OF THE INVENTION

The present invention provides a method and apparatus for supporting the walls of a deep trench a number of times the depth of the trench box or trench shield used to support the trench walls at the trench entrance adjacent the surface of the excavation. A trench is dug to a first depth and the walls about the trench are supported by a trench box or shield. A series of soldier piles are sunk into the ground in front of the trench box or shield and guided into proper position by a series of guides on the front panel of the trench box or shield. The soldier piles can be as long as desired, and are selected to exceed the pit depth so that the ends will engage the soil below the pit floor.

The soldier piles can have a generally I-beam configuration to handle single plates between adjacent piles or the soldier pile channels can be subdivided into multiple channels to handle three plates in face-to-face relationship. Each channel has a stop at a fixed depth. Thus, the plate in the channel closest to the trench box or shield is positioned first, then the next one is moved to a lower depth as the trench is dug deeper, and finally the plate remote from the trench box or shield is set in place as the trench excavation is completed. It is an object of this invention to provide an improved method and apparatus to support an excavation.

It is another object of this invention to provide an improved method and apparatus to support an excavation using soldier piles.

It is still another object of this invention to provide an improved method and apparatus to support an excavation using soldier piles and plates movable within the channels of said soldier piles.

It is yet another object of this invention to provide an improved method and apparatus to support an excavation using soldier piles having a plurality of channels and a plurality of plates, one for each channel and extendable in staggered relationship below a trench box or shield whereby an excavation of a depth a number of times greater than the height of the trench box or shield can be supported and shored.

Other objects and features of the invention will be pointed out in the following description and claims and illustrated in the accompanying drawings which disclose, by way of example, the principles of the invention and the best modes which have been presently contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
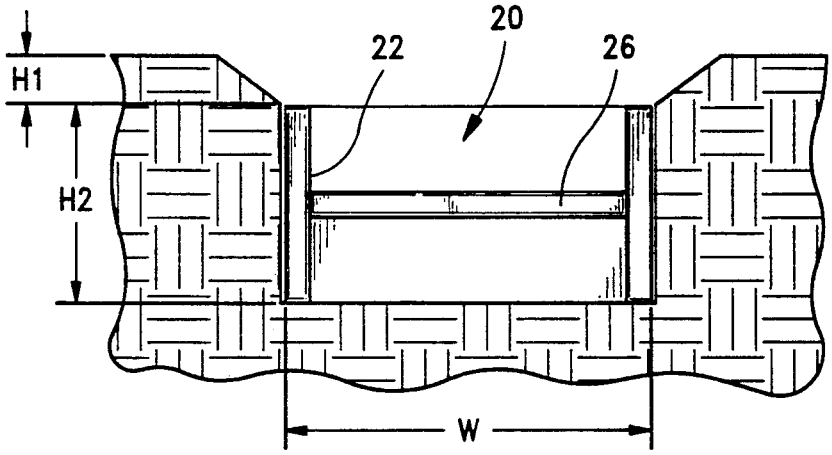
FIG. 1 is a side elevational view of a trench first stage with trench box side walls and temporary struts installed.
Figure 2:
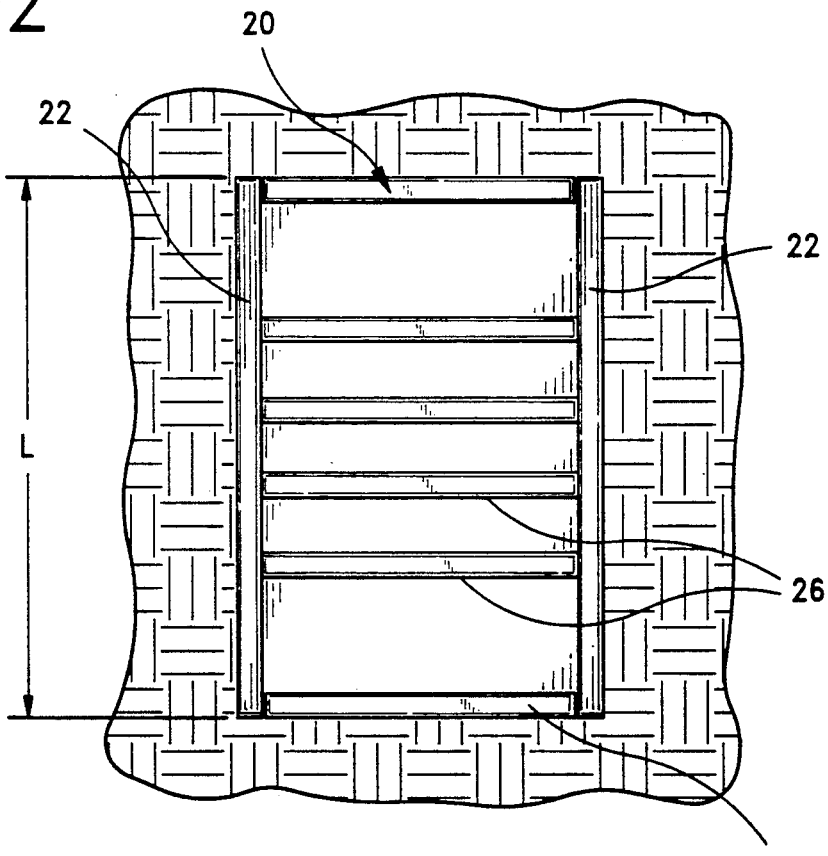
FIG. 2 is a top plan view of the excavation of FIG. 1 with the trench box completed by the addition of end walls or panels.

Turning now to FIGS. 1 to 8, the method and apparatus used to construct and reinforce the preliminary portion of the trench excavation 20 is shown. Typically this type of trench is dug with a width of about 13 feet, a height of eight feet with a low portion $H_2$ of five feet and an outwardly tapered lead section of a height $H_1$ of three feet. The trench is about 43 feet in length as shown by L in FIG. 2. Once dug, the side walls of the trench 20 are supported to prevent a cave-in of the soil by side panels 22 and end panels 24, and the side panels are shored up by temporary struts 26. The side panels 22 and end panels 24 are prefabricated structures which can be inserted and removed and re-used at other excavation sites.

Figure 4:
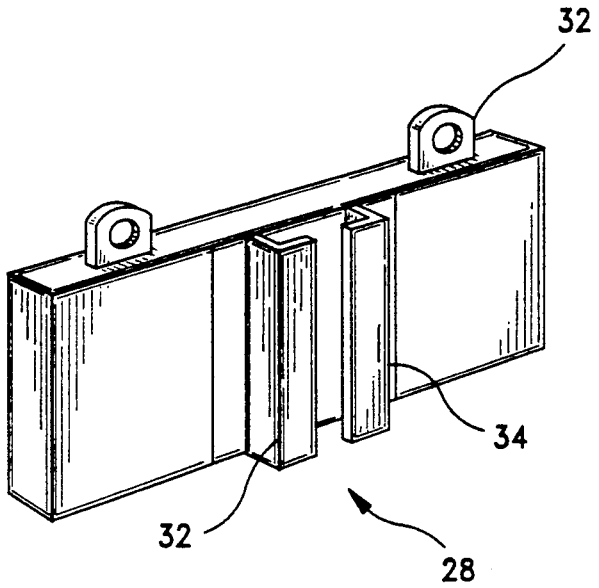
FIG. 4 is a front perspective view of a side wall or side panel used as a trench box or trench shield.
Figure 5:
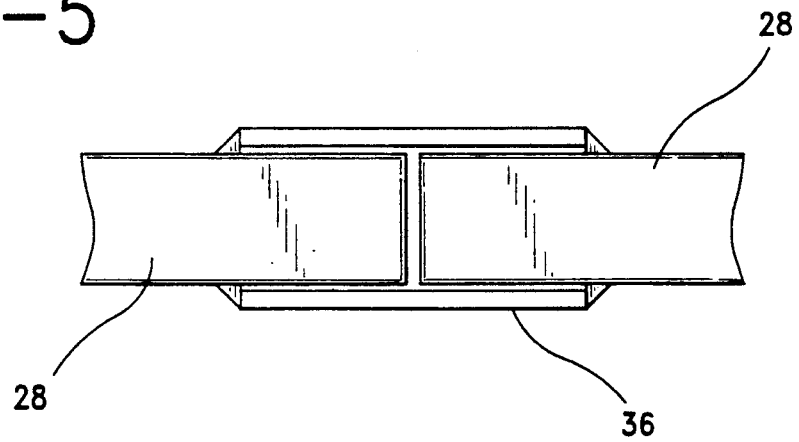
FIG. 5 is a fragmentary top plan view of a joint member used to join two side wall sections or side panels.
Figure 7:
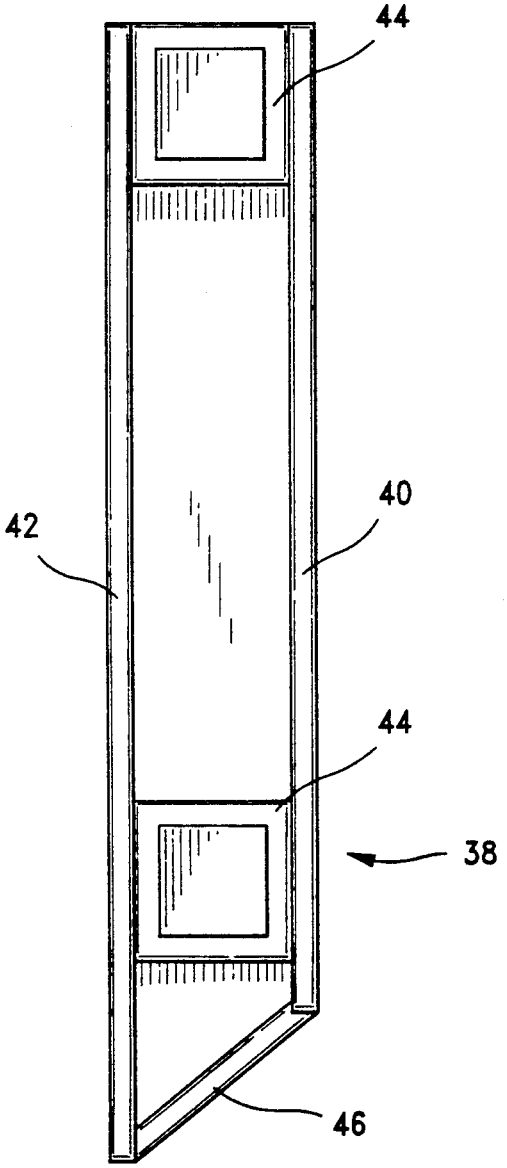
FIG. 7 is a side view of an alternative form of side wall or side panel used as a trench box or trench shield.

The side panels can be fabricated as of reinforced concrete as shown in FIG. 4 . Panel 28 has a reinforcement structure of steel beams (not shown) to which are attached lifting eyes 30 and a channel structure including shoulders 32, 34 to receive the soldier piles as set forth below. Two side panels 28 can be joined by the joint 36 shown in FIG. 5 which serves to hold the two side panels 28 in alignment. The side panels 22 can also be fabricated of steel plates joined together. As shown in FIG. 7, a front steel plate 40 of side panel 38 is joined to a rear steel plate 42 by means of the square spacer tubes 44 formed adjacent the top of plates 40, 42 and near the bottom of these plates. A terminal wall 46 prevents the soil from entering side panel 38 when it is placed. A suitable tool jaw or a chain through upper tube 44 permits the side panel 38 to be placed as desired.

Figure 8:
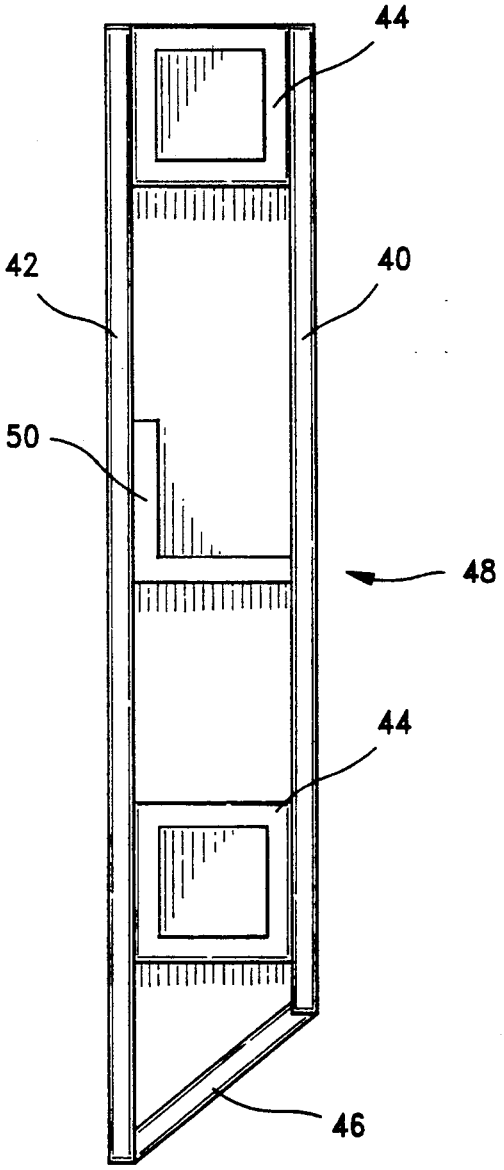
FIG. 8 is a side view of yet another form of side wall or side panel used as a trench box or trench shield.

For some applications, it is desirable that the preliminary portion of the trench be deeper than five feet and in the range of ten feet or even where the trench box or shield must provide greater strength, the side panel 38 of FIG. 7 can be modified to side panel 48 of FIG. 8 which includes the strengthening rib 50 or could, if desired, include additional spacer tubes 44.

Figure 3:
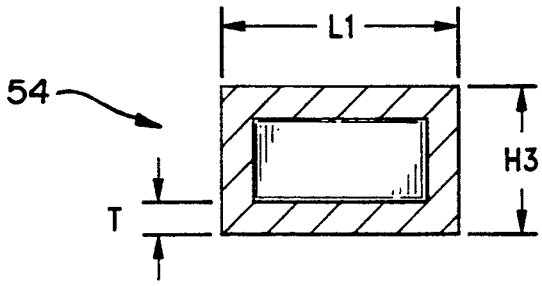
FIG. 3 is a side elevational view, in section, of a temporary strut of the type shown in FIG. 1.

The temporary struts 54 as shown in FIG. 3 are closed steel boxes whose length $L_1$ is generally eight inches, height $H_3$ is six and three quarters inches and has a thickness of five-eighths of an inch and an overall length of approximately eleven feet. These struts are generally placed at thirty inch intervals along the side panels. Alternatively, the struts could be suitably sized timbers.

Figure 6:
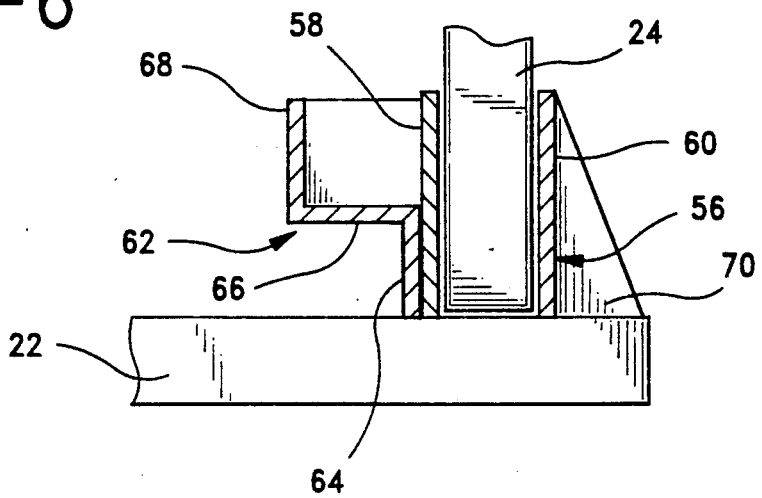
FIG. 6 is a fragmentary top plan view of the joint used to assemble an end panel to a side wall or panel and to accommodate reinforcement plates.

To hold end panel 24 assembled to side panels 22 (only one of which is shown in FIG. 6), a U-shaped bracket 56 is employed. U-shaped bracket 56 has two upstanding arms 58, 60 which may be extensions of the reinforcement structure of side panel 28 of FIG. 4 or added to front plate 40 of side panels 38 and 48 of FIGS. 7 and 8, respectively. Welded to arm 58 is a further bracket 62 welded by joining portion 64 to arm 58. Portion 64, together with portion 66, form a channel to receive a reinforcement plate (not shown) for side panel 22, while portion 66 with portion 68 receive a reinforcement plate for end panel 24 (not shown). A final fillet or plate 70 is attached between side panel 22 and arm 60 to further support bracket 56.

Figure 14:
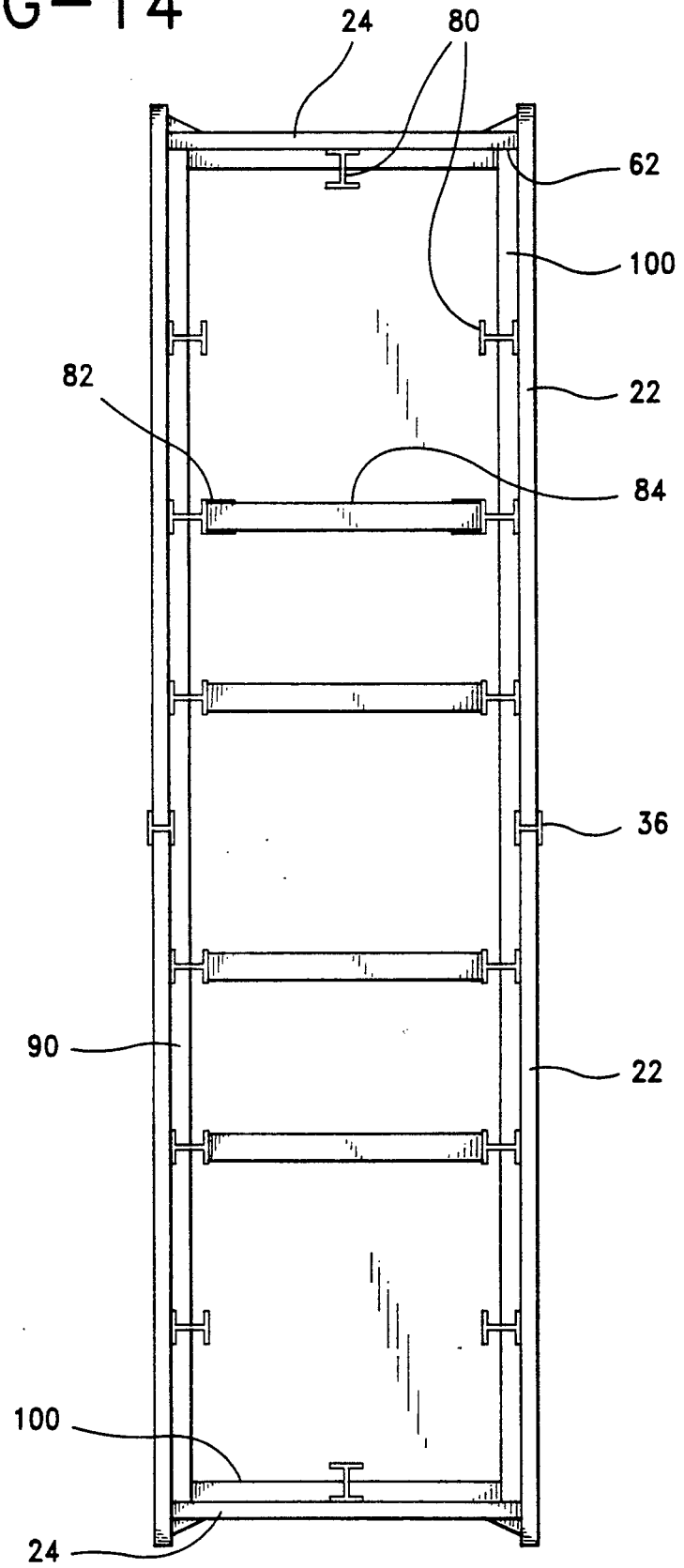
FIG. 14 is a top plan view of the excavation of FIG. 11.

Once the trench box or trench shield (made up of side panels such as 28, 38 or 48, end panels such as 24) is in place, the temporary struts 54 are removed and the remainder of the excavation 20 completed as shown in FIG. 14. The remainder may be in the range of 12 feet to 32 feet, giving a total excavation depth of 20 feet to 40 feet. For shallow excavations, the excavation may be completed once the trench box or trench shield is in place. For deeper excavations, the excavation is done in stages as will be set forth below.

Figure 9:
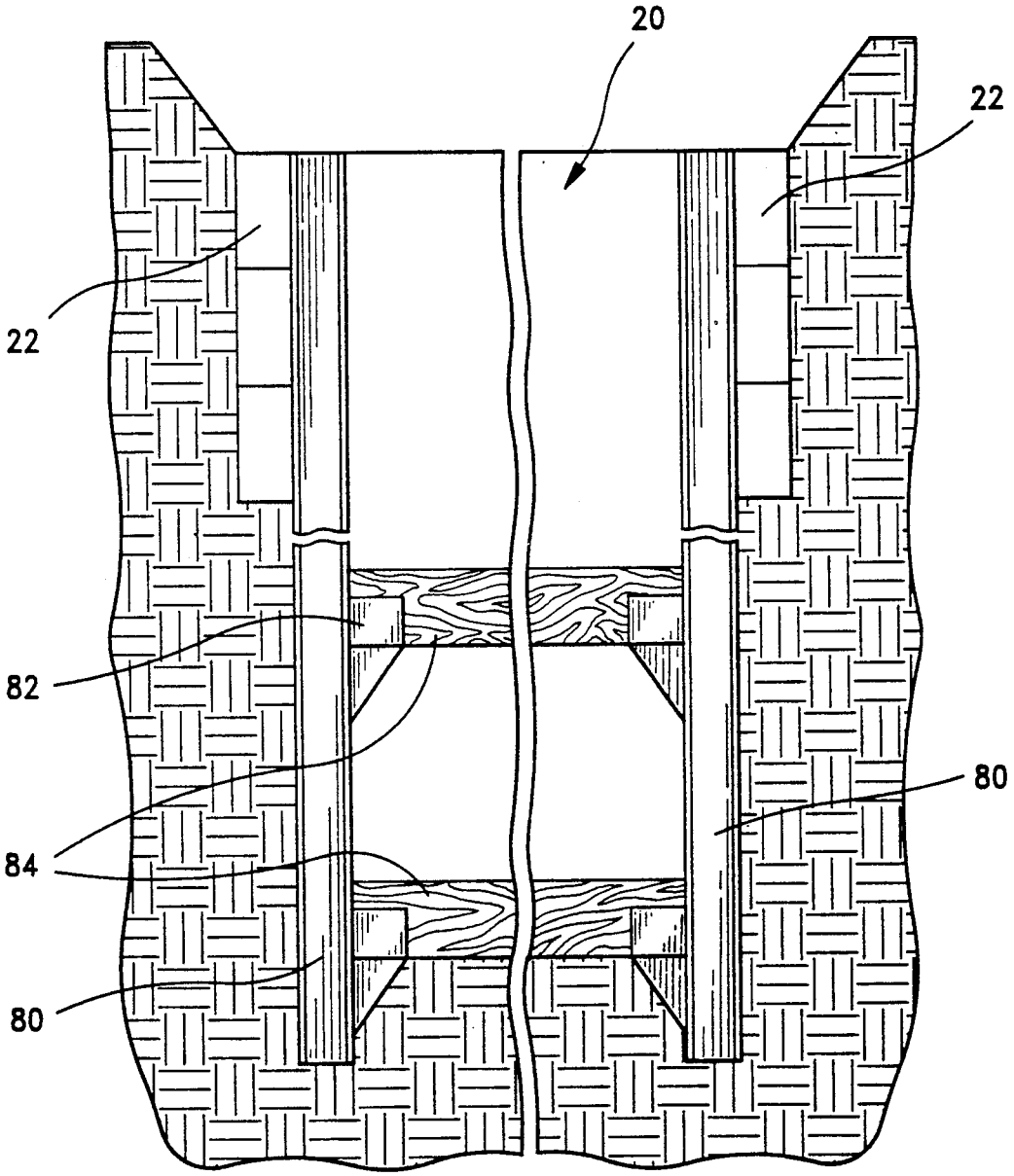
FIG. 9 is a side view of an excavation according to the present method and apparatus showing the trench box and soldier piles with temporary struts in place and the side panels removed so that the inner details are visible.
Figure 10:
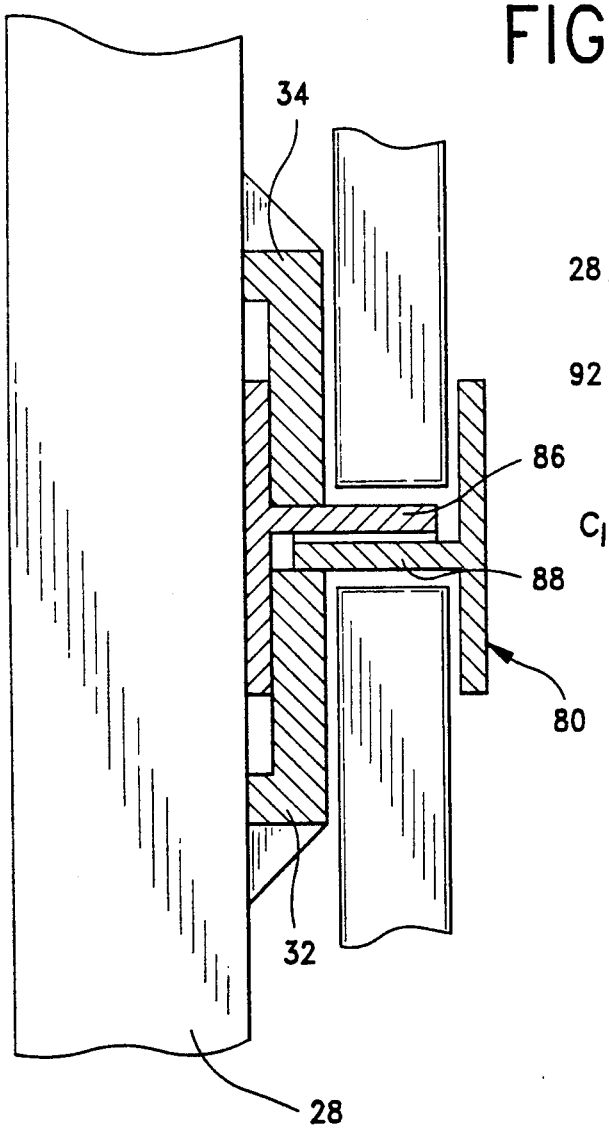
FIG. 10 is a fragmentary top plan view, partially in section, showing one form of soldier pile and a channel of the side panel.

Now the soldier piles 80 are driven into the excavation 20 floor so to extend approximately two to five feet below the excavation bottom to anchor the soldier piles 80 as shown in FIG. 9. Included on the front face of soldier piles 80 are a series of Y-shaped brackets 82, better seen on FIG. 13, which support a series of temporary struts 84 to hold the positions of the soldier piles 80. The soldier piles 80 may be in the form of I-beams or two T-sections joined to form an I-beam of the desired dimensions. As shown in FIG. 10, side panel 28 has two L-shaped shoulders 32, 34 which create therebetween a channel to receive soldier pile 80, and thus assure that the position of the soldier piles 80 are directly adjacent the faces of side panels 28.

Soldier pile 80 is made up of two T-shaped sections 86, 88 joined along their free legs, as by welding, so that the distance between the respective T-bars can be controlled to receive only one set of reinforcement plates. If the soldier piles are to be used with the deeper excavations and multiple reinforcement plate pairs are to be employed, then a full I-beam 90 is used as in FIG. 12. Flange 92 is set in the channel made up of shoulders 32, 34 on side plate 28, and flange 94 is spaced therefrom. Channel wall members 98 are then welded along arm 96 joining flanges 92, 94 at suitable distances to establish three separate channels for pairs of reinforcement plates as will be discussed below. It should be noted that the support bracket 56 and further bracket 62 of FIG. 6 have a total length equal to the soldier piles 80, and that bracket 56 and the channels created by arm portions 64, 66 and arm 58 and portion 68 are also divided into three channels each to handle three sets of reinforcement plates.

Although the discussion has been in terms of side panels 22, 28, 38 and 48, it should be understood that the form of end panels 24 can be the same as the side panels 28, 38 and 48 except that their length is shorter. The end panels 24 will also have channels formed of shoulders such as 32, 34 and will receive soldier piles as well. The reinforcement plates for the end panels will be moved in a combination of the soldier pile channels and the end brackets as is true of the reinforcement plates for the end plates of the side panels 22.

Now the reinforcement plates 100 are added to reinforce the walls of the excavation below the trench box or trench shield side walls 22. The plates 100 will rest on the floor of the excavation 20 or may be driven below such floor.

Figure 12:
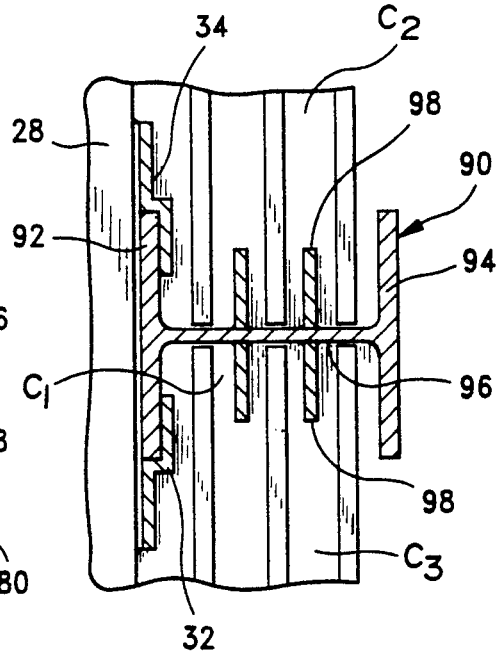
FIG. 12 is a fragmentary top plan view, partially in section, of a multi-channel soldier plate and a channel of the side panel.
Figure 11:
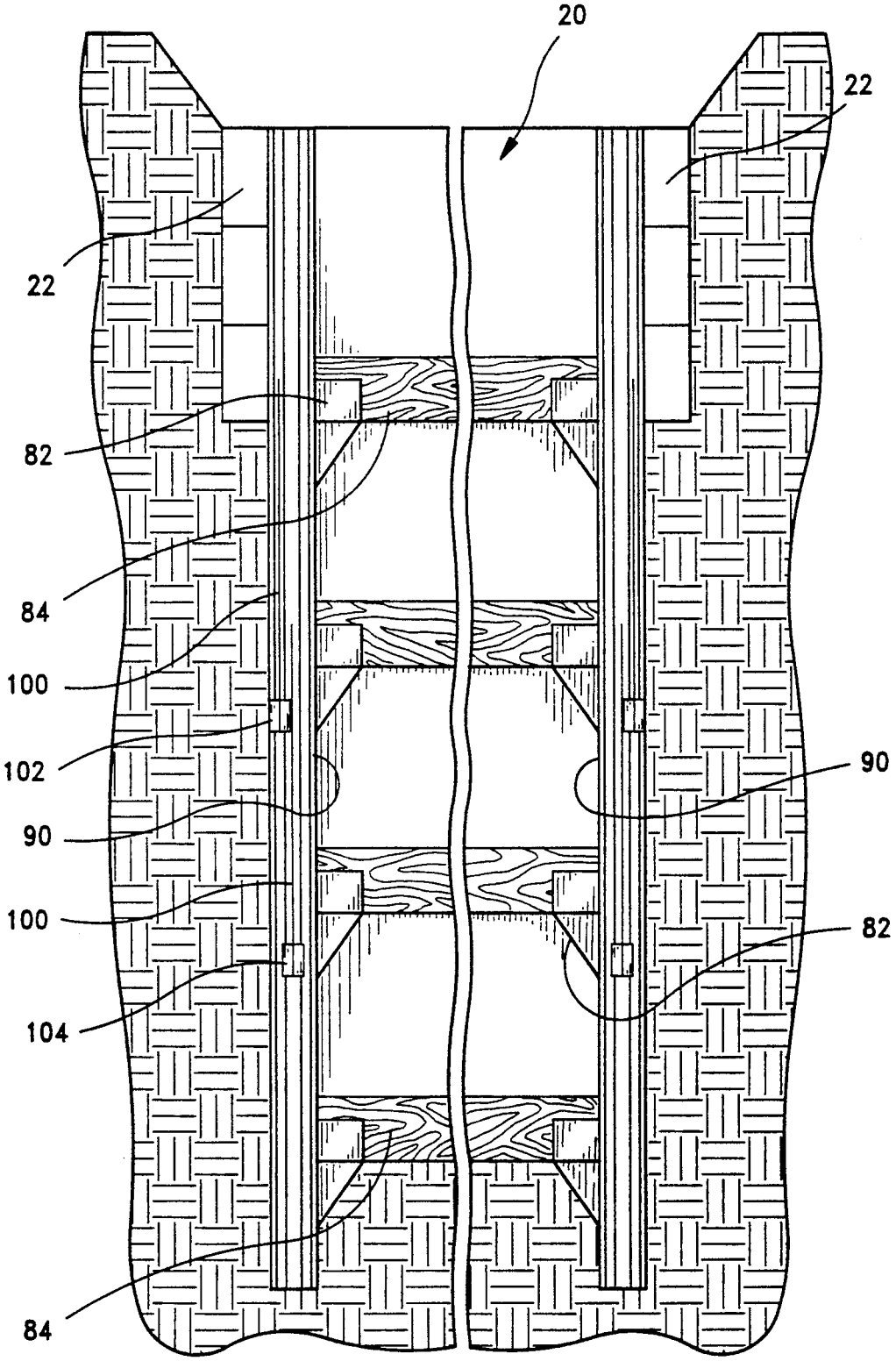
FIG. 11 is a side view of an excavation according to the present method and apparatus showing the trench box and soldier piles in place with the reinforcement plates set and the temporary struts placed and the side panels removed so that the inner details are visible.
Figure 13:
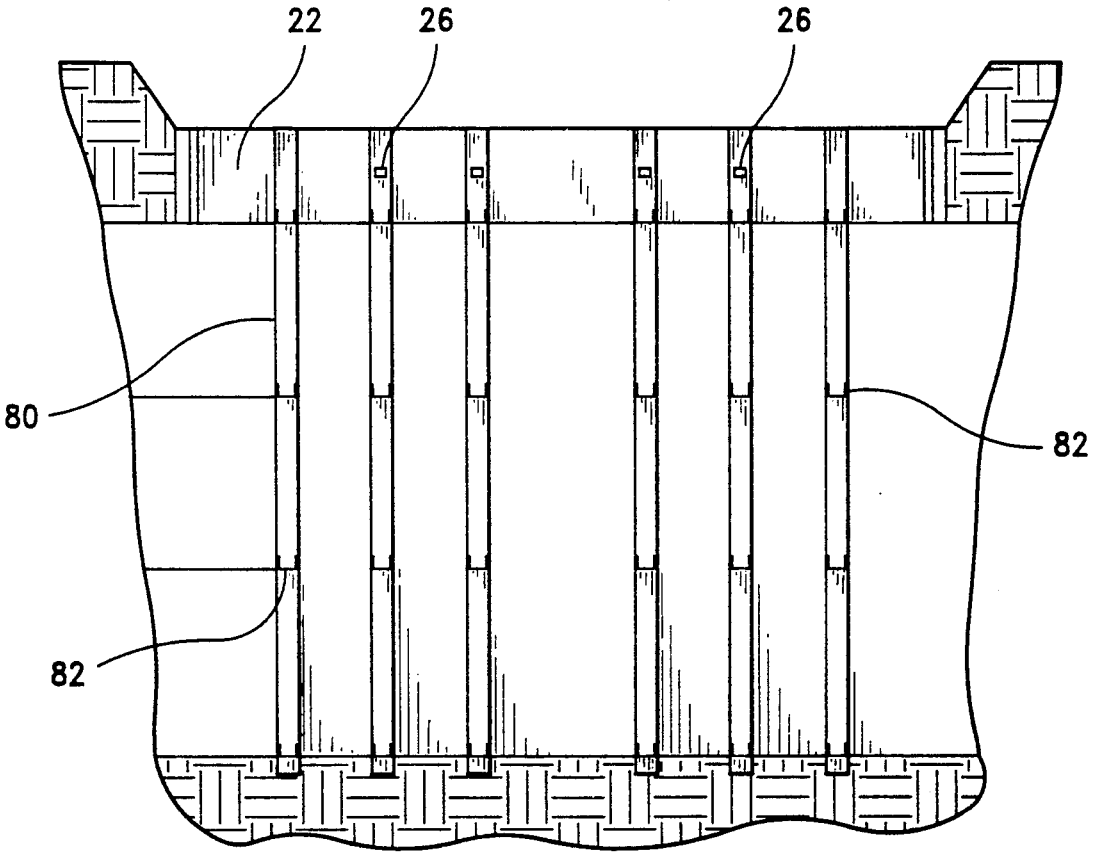
FIG. 13 is a front elevational view of one wall of the excavation of FIG. 11.

As the excavation 20 becomes deeper, it is not possible to shore up the excavation walls with a single level of reinforcement plates 100, because the plates become too large and too heavy to move. Instead, multiple levels of reinforcement plates 100 are used and the pit is dug to its maximum depth in stages. Turning now to FIGS. 11 and 13, there is shown the arrangement of three levels of reinforcement plates 100 to shore up the walls of an excavation having a total depth of forty feet. The trench box or trench shield is fabricated in the preliminary portion of the excavation employing side walls 22, and the soldier piles 90, as shown in FIG. 12, are sunk into the excavation 20 floor as above-described. A series of struts 84 are placed in the brackets 82 on the face of soldier piles 90 to fix the positions of such soldier piles 90. A first level of reinforcement plates 100 is positioned in the channel $C_1$ closest to the walls of excavation 20 and moved downwardly until it comes to rest against stop 102 in channel $C_1$ which prevents further downward movement of plate 100 and fixes its position with respect to the side wall 22 and the side wall of the excavation 20. The excavation 20 is now dug deeper by approximately the height of a reinforcement plate.

Next, a further reinforcement plate 100 is placed in each of the channels $C_2$ and moved downwardly until they come to rest against a stop 104 in channel $C_2$. The second plate 100 takes a position such that it overlaps the end of plate 100 in channel $C_1$, so there are no gaps through which the wall could penetrate. Again, the excavation is made deeper by approximately the same amount as before. Finally, a third level of plates is lowered in channel $C_3$ until the plates 100 strike the excavation 20 bottom preventing further downward movement If desired, the plates can be driven below the excavation floor. The plates 100 in channel $C_3$ are furthest from the excavation 20 walls and overlap the bottom of plates 100 in channel $C_2$ to prevent undesired gaps.

Excavations of more than 20 feet but less than 40 feet could use two levels of reinforcement plates 100, or smaller plates 100 could be used for the shorter holes even though three levels of plates 100 are employed.

While there have been shown and described and pointed out the fundamental novel features of the invention as applied to the preferred embodiments, it will be understood that various omissions and substitutions and changes of the form and details of the devices illustrated and in their operation may be made by those skilled in the art without departure from the spirit of the invention.

I claim:

1. The method of shoring the walls of a pit dug into soil comprising the steps of:

a. digging a first trench portion having a top adjacent the surface of said soil and a bottom remote from said soil surface defining therebetween first walls;

b. placing a reinforcing structure in said first trench portion co-extensive with said first walls to support the soil about said first trench portion;

c. placing guides in front of said reinforcement structure within said pit, said guides extending from said top of said first trench portion into the soil below said bottom of said first trench portion;

d. positioning reinforcement plates between said guides, said reinforcement plates being supported by the soil at said bottom of said first trench portion;

e. digging a second trench portion having a top adjacent said first trench portion bottom and a bottom remote from said soil surface defining therebetween second walls, said second trench portion being substantially continuous with said first trench portion; and f. Moving said reinforcement plates along said guides until said reinforcement plates are adjacent said second walls to support the soil about said second trench portion.

2. The method of shoring as claimed in claim 1, including the further step of bracing said reinforcement structure across said pit to prevent the inward collapse of said reinforcement structure.

3. The method of shoring as claimed in claim 1, including the further step of bracing said guides across said pit to prevent the inward collapse of said guides and said reinforcement plates.

4. The method of shoring as claimed in claim 1, including the further steps of:

a. bracing said reinforcement structure across said pit to prevent the inward collapse of said reinforcement structure; and b. bracing said guides across said pit to prevent the inward collapse of said guides and said reinforcement plates.

5. The method of shoring as claimed in claim 1, including the further steps of:

a. dividing said guides into two parallel channels, one behind the other;

b. positioning first reinforcement plates in a first of said channels and moving said first reinforcement plates along said first channels of said guides until said first reinforcement plates are adjacent a first portion of said second walls; and c. positioning second reinforcement plates in the second of said channels and moving said second reinforcement plates along said second channels of said guides until said second reinforcement plates are adjacent a second portion of said second walls whereby said first and said second reinforcement plates substantially cover said second walls.

6. The method of shoring as claimed in claim 1, including the further steps of:

a. dividing said guides into three parallel channels, one behind the other;

b. positioning first reinforcement plates in the first of said channels adjacent said second walls and moving said first reinforcement plates along said first channels of said guides until said first reinforcement plates are adjacent a first portion of said second walls;

c. positioning second reinforcement plates in the next adjacent channels of said guides and moving said second reinforcement plates along said second channels of said guides until said second reinforcement plates are adjacent a second portion of said second walls; and d. positioning third reinforcement plates in the third channels of said guides remote from said second walls and moving said third reinforcement plates along said third channels of said guides until said third reinforcement plates are adjacent a third portion of said second walls, whereby said first, second and third reinforcement plates substantially cover said second walls.

7. The method of shoring as claimed in claim 1, wherein the step of digging the first trench comprises the step of digging a rectangular trench having long opposed walls and shorter opposed ends.

8. The method of shoring as claimed in claim 1, wherein the step of placing a reinforcement structure comprises the steps of:

a. placing at least two long panels along each of said long walls; and b. placing one panel along each of said shorter ends, the ends of said panel engaging the adjacent long panels whereby a substantially closed reinforcement structure is created.

9. The method of shoring as claimed in claim 8, wherein the step of placing said reinforcement structure within said pit includes the steps of:

a. placing guides in front of said long panels and said short panels; and said step of positioning reinforcement plates between said guides includes the steps of:

b. positioning said reinforcement plates in the guides in front of said long panels and said short panels and moving said reinforcement plates along said guides until said reinforcement plates for a substantially closed structure adjacent and within said second walls.

10. An apparatus for shoring the walls of a pit having two side walls and two end walls extending between a top adjacent the surface of the soil in which said pit is dug and a bottom of a first predetermined depth below said soil surface comprising:

a. reinforcement structure means extending from adjacent said soil surface a second predetermined depth less than said first predetermined depth and about said side walls and end walls to form a closed structure to support the soil about said reinforcement structure means;

b. a plurality of guide means each having at least two channels therein, said guide means being positioned in front of said reinforcement structure means and extending through the soil at the bottom of said pit;

c. a plurality of reinforcement plates each positioned between adjacent guide means and movable in the channels thereof below said reinforcement structure means to the bottom of said pit whereby the portions of said two side walls and said two end walls below said second predetermined depth to the bottom of said pit are enclosed to support the soil thereabout.

11. An apparatus for shoring as claimed in claim 10, wherein said reinforcement structure means are a plurality of concrete reinforced panels.

12. An apparatus for shoring as claimed in claim 10, wherein said reinforcement structure means are a plurality of hollow structures made of a front plate and a rear plate joined and spaced by supports coupled therebetween.

13. An apparatus for shoring as claimed in claim 10, furthering including strut means positioned between said reinforcement structure means adjacent said side walls and between said guide means along said side walls to prevent said reinforcement structure means and said guide means from being displaced inwardly into the pit by the soil of said pit side walls.

14. An apparatus for shoring as claimed in claim 10, wherein each of said guide means have sets of multiple channels, each channel able to receive a reinforcement plate movable therein.

15. An apparatus for shoring as claimed in claim 14, wherein each of said multiple channels has a stop means therein so that said reinforcement plates are fixed at different pit levels in each of said channels whereby the portion of said two side walls and said two end walls below said second predetermined depth to the bottom of said pit are enclosed to support the soil thereabout.

16. An apparatus for shoring as claimed in claim 15, wherein said stop means are arranged so that the top portion of each succeeding reinforcing plate covers the bottom portion of the preceding reinforcing plate so that there is no gap in the coverage of said pit side walls and end walls.

17. An apparatus for shoring as claimed in claim 14, wherein each of said guide means have sets of three channels each, each channel able to receive a reinforcement plate movable therein.

18. An apparatus for shoring as claimed in claim 17, wherein each of said three channels has a stop means positioned along its length whereby reinforcement plates placed in each of said channels descends to a different depth in said pit with portions overlapping the adjacent plates whereby the side walls and end walls of said pit are enclosed with gaps between said reinforcement plates.

19. An apparatus for shoring as claimed in claim 10, wherein said guide means are formed of two T-portions joined along their extended legs.

20. an apparatus for shoring as claimed in claim 14, wherein said guide means is formed of an I-beam with the space between its parallel flanges subdivided by tabs affixed thereto.

* * * * *